US010654291B2

(12) United States Patent
Fujisawa

(10) Patent No.: US 10,654,291 B2
(45) Date of Patent: May 19, 2020

(54) PRINTING APPARATUS

(71) Applicant: SEIKO EPSON CORPORATION, Tokyo (JP)

(72) Inventor: Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/291,496

(22) Filed: Mar. 4, 2019

(65) Prior Publication Data

US 2019/0270317 A1 Sep. 5, 2019

(30) Foreign Application Priority Data

Mar. 5, 2018 (JP) ..... 2018-038727

(51) Int. Cl.
*B41J 11/00* (2006.01)
*B41J 15/04* (2006.01)

(52) U.S. Cl.
CPC ..... *B41J 11/002* (2013.01); *B41J 15/04* (2013.01)

(58) Field of Classification Search
CPC . B41J 11/002; B41J 29/12; B41J 29/13; B41J 29/19; B41J 2002/14185; B41J 11/0015; B41J 15/04; B41M 7/0072; B41M 7/0081
See application file for complete search history.

(56) References Cited

U.S. PATENT DOCUMENTS 7,789,503 B2 * 9/2010 Kusunoki ..... B41J 11/002 347/101
2014/0253634 A1 * 9/2014 Kobayashi ..... B41J 2/16538 347/33
2014/0292969 A1 10/2014 Tanaka et al.
2015/0231897 A1 * 8/2015 Noell ..... B41J 3/4073 347/102
2015/0321489 A1 11/2015 Tanaka et al.
2017/0313100 A1 11/2017 Hori et al.

FOREIGN PATENT DOCUMENTS

JP 2004-314585 A 11/2004
JP 06171484 B 7/2017
JP 2017-196795 A 11/2017

* cited by examiner

*Primary Examiner* — Henok D Legesse
(74) *Attorney, Agent, or Firm* — Workman Nydegger

(57) ABSTRACT

A printing apparatus includes a support member including a curved surface that supports a recording medium conveyed in a predetermined conveyance direction, a discharging head that discharges liquid from a nozzle of a nozzle surface disposed in a position facing the support member to print an image on the recording medium on the curved surface, an irradiation section that includes a housing and a light emitting section and that irradiates the recording medium on the curved surface with light emitted from the light emitting section via an irradiation port, and a light-shielding plate disposed between the discharging head and the irradiation section. The housing of the irradiation section is disposed in a position farther from the curved surface than a virtual tangent plane that passes through a portion of the nozzle surface being farthest from the irradiation port and that contacts a lower end of the light-shielding plate.

2 Claims, 5 Drawing Sheets

$G_1 > G_2$

PRINTING APPARATUS

BACKGROUND

1. Technical Field

The invention relates to a printing apparatus.

2. Related Art

A known technique for performing printing in a drum-type printing apparatus by using photocurable ink is proposed (for example, see JP-A-2017-196795). In the technique described in JP-A-2017-196795, a light irradiation apparatus that irradiates UV light toward a recording medium is disposed to be adjacent to each printing head, and an inclined portion is provided around an irradiation port of the light irradiation apparatus, so that a part of the UV light (leakage light) is prevented from being incident to a nozzle surface of each printing head. It is assumed that curing of ink adhering to a nozzle surface due to leakage light can be reduced by adopting the technique.

However, it has been determined that ink adhering to a nozzle surface of each printing head is cured when printing continues for a long time even by adopting the configuration described in JP-A-2017-196795. The inventor of the claimed invention has found that the above-described phenomenon is caused by a part of light (scattered light) scattered around an irradiation port of a light irradiation apparatus being incident to a nozzle surface. Since the scattered light is generated around a light source and the number of times of reflection is relatively small, it is clear that the scattered light has relatively high intensity when reaching the nozzle surface and greatly contributes to curing of ink adhering to the nozzle surface.

SUMMARY

The invention has been made in view of such a situation, and an advantage of some aspects of the invention is to prevent a part of light (scattered light) scattered around an irradiation port of a light irradiation apparatus from being incident to a nozzle surface of a printing head in a printing apparatus that performs printing by using photocurable ink.

To achieve the advantage of some aspects of the invention, a printing apparatus according to an aspect of the invention includes a support member including a curved surface configured to support a recording medium conveyed in a predetermined conveyance direction, a discharging head configured to discharge liquid from a nozzle of a nozzle surface disposed in a position facing the support member to print an image on the recording medium supported by the curved surface, an irradiation section including a housing and a light emitting section accommodated inside the housing and configured to irradiate light for curing the liquid, the irradiation section being configured to irradiate the recording medium supported by the curved surface with light emitted from the light emitting section via an irradiation port defined by the housing, and a light-shielding plate disposed between the discharging head and the irradiation section in the conveyance direction. The housing is disposed in a position farther from the curved surface than a virtual tangent plane that passes through a portion of the nozzle surface being farthest from the irradiation port and that contacts a lower end of the light-shielding plate.

By adopting such a configuration, the housing of the irradiation section is disposed in the position farther from the curved surface of the support member supporting the recording medium than a specific virtual tangent plane (virtual tangent plane that passes through the portion of the nozzle surface of the discharging head being farthest from the irradiation port of the irradiation section and that contacts the lower end of the light-shielding plate). Thus, the light-shielding plate can intercept all scattered light around the irradiation port, and a part of the scattered light can be prevented from being incident to the nozzle surface of the discharging head. Therefore, curing of ink adhering to the nozzle surface due to a part of the scattered light being incident to the nozzle surface of the discharging head can be prevented.

In the printing apparatus according to an aspect of the invention, a gap between the light-shielding plate and the support member can be wider than a gap between the discharging head and the support member.

By adopting such a configuration, the light-shielding plate can be prevented from contacting the recording medium supported by the curved surface of the support member. Thus, damage to the recording medium can be prevented.

In the printing apparatus according to an aspect of the invention, the discharging head that has already been described is a first discharging head disposed upstream of the irradiation section in the conveyance direction, the light-shielding plate that has already been described is a first light-shielding plate disposed upstream of the irradiation section in the conveyance direction, the virtual tangent plane that has already been described is a first virtual tangent plane that passes through a position of the nozzle surface of the first discharging head being farthest from the irradiation port and that contacts a lower end of the first light-shielding plate. In such a case, the printing apparatus further includes a second light-shielding plate disposed downstream of the irradiation section in the conveyance direction, and a second discharging head disposed downstream of the second light-shielding plate in the conveyance direction. The housing can be disposed in a position farther from the curved surface than a second virtual tangent plane that passes through a portion of the nozzle surface of the second discharging head being farthest from the irradiation port and that contacts a lower end of the second light-shielding plate.

By adopting such a configuration, the housing of the irradiation section is disposed in the position farther from the curved surface of the support member than two virtual tangent planes (the first virtual tangent plane located upstream of the irradiation section and the second virtual target plane located downstream of the irradiation section). Thus, the first and second light-shielding plates can intercept all scattered light around the irradiation port, and a part of the scattered light can be prevented from being incident to the nozzle surfaces of the first and second discharging heads. Therefore, curing of ink adhering to the nozzle surfaces due to a part of the scattered light being incident to the nozzle surfaces of the first and second discharging heads can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of a printing apparatus 1 according to the invention will be described below with reference to the accompanying drawings. Note that the invention is not limited to the exemplary embodiments.

Figure 1:
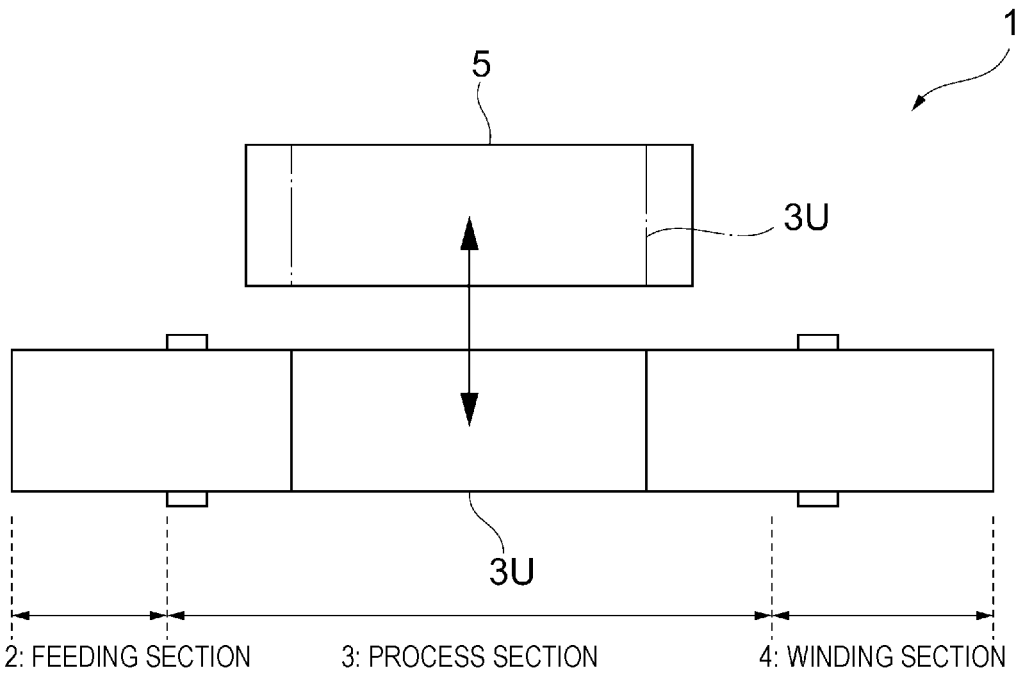
FIG. 1 is a plan view (diagram seen from above) illustrating a layout of a printing apparatus according to an exemplary embodiment of the invention.
Figure 1:
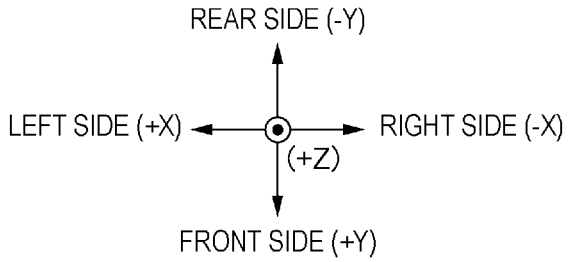
Figure 2:
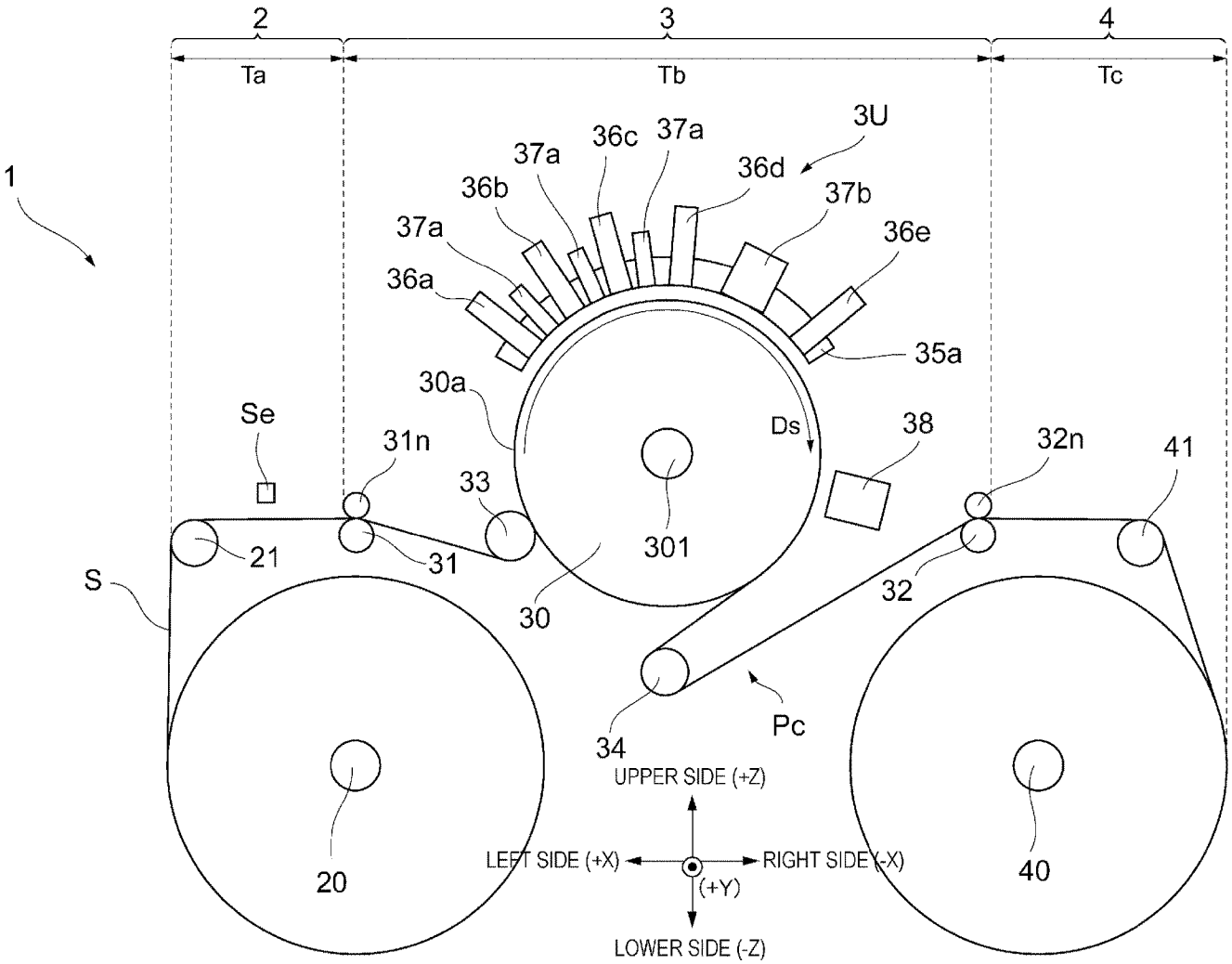
FIG. 2 is a front view (diagram seen from the front) illustrating an overall configuration of the printing apparatus according to the exemplary embodiment of the invention.

FIG. 1 is a plan view illustrating a layout of the printing apparatus 1 equipped with a head movement mechanism according to an exemplary embodiment of the invention. FIG. 2 is a front view illustrating an overall configuration of the printing apparatus 1 illustrated in FIG. 1. The printing apparatus 1 includes a feeding section 2, a process section 3, and a winding section 4 arranged in a right-and-left direction on the front side of the apparatus, a maintenance section 5 disposed on the rear side of the process section 3, and a process unit 3U of the process section 3 that is movable integrally with the maintenance section 5. Note that a three-dimensional coordinate system corresponding to a right-and-left direction X, a front-back direction Y, and a vertical direction Z of the printing apparatus 1 is adopted in the drawings and drawings described later.

As illustrated in FIG. 2, the feeding section 2 and the winding section 4 respectively include a feeding shaft 20 and a winding shaft 40 in the printing apparatus 1. Both ends of a sheet S are wound by the feeding section 2 and the winding section 4 in a roll form and stretched between the feeding section 2 and the winding section 4. The sheet S is conveyed from the feeding section 2 to the process section 3 along a path Pc in which the sheet S is stretched in such a manner, subjected to printing processing by the process unit 3U, and then conveyed to the winding section 4. Types of the sheet S corresponding to a "recording medium" of the invention are broadly divided into a paper-based type and a film-based type. To give specific examples, the paper-based type includes woodfree paper, cast paper, art paper, coated paper, and the like, and the film-based type includes synthetic paper, Polyethylene terephthalate (PET), polypropylene (PP), and the like. Note that in the following description, of both surfaces of the sheet S, the surface on which the image is recorded will be referred to as a front surface and the reverse side surface of the front surface will be referred to as a back surface.

The feeding section 2 includes the feeding shaft 20 around which an edge of the sheet S is wound, and a driven roller 21 on which the sheet S drawn out from the feeding shaft 20 is wound. The feeding shaft 20 supports the sheet S by winding the edge of the sheet S around the feeding shaft 20 with the front surface of the sheet S facing outward. In addition, when the feeding shaft 20 is rotated clockwise in FIG. 2, the sheet S wound around the feeding shaft 20 is fed to the process section 3 via the driven roller 21. In this regard, the sheet S is wound around the feeding shaft 20 via a core pipe (not illustrated) that is detachable from the feeding shaft 20. Thus, when the sheet S around the feeding shaft 20 is used up, it is possible to attach, to the feeding shaft 20, a new core pipe around which the rolled sheet S has been wound to replace the sheet S around the feeding shaft 20. Note that a reference sign Se in FIG. 2 represents an edge sensor that detects an edge of the sheet S in a width direction between the driven roller 21 and a front driving roller 31.

While supporting the sheet S fed from the feeding section 2 by a front surface (curved surface) 30*a* of a platen drum (support member) 30, the process section 3 performs processing for printing an image on the sheet S, as appropriate, by the process unit 3U disposed along the front surface 30*a* of the platen drum 30. In the process section 3, the front driving roller 31 and a rear driving roller 32 are provided on both sides of the platen drum 30, and the sheet S conveyed from the front driving roller 31 to the rear driving roller 32 is supported by the platen drum 30 and is subjected to image printing.

The front driving roller 31 has a plurality of minute protrusions formed on the outer circumferential surface of the front driving roller 31 by thermal spraying, and the sheet S fed from the feeding section 2 is wound on the front driving roller 31 from the back surface side of the sheet S. In addition, by being rotated clockwise in FIG. 2, the front driving roller 31 conveys the sheet S fed from the feeding section 2 downstream in a conveyance path. Note that a nip roller 31*n* is provided with respect to the front driving roller 31. The nip roller 31*n* makes contact with the front surface of the sheet S while being biased toward the front driving roller 31, and the sheet S is sandwiched between the nip roller 31*n* and the front driving roller 31. This makes it possible to secure a frictional force between the front driving roller 31 and the sheet S and reliably perform conveyance of the sheet S by the front driving roller 31.

The platen drum 30 is a cylindrical drum supported rotatably around a rotary shaft 301 extending in the Y direction by a support mechanism (not illustrated), and winds the sheet S conveyed from the front driving roller 31 to the rear driving roller 32 from the back surface side. The platen drum 30 supports the sheet S by the front surface (curved surface) 30*a* of the platen drum 30 from the back surface side of the sheet S while being driven to rotate in a conveyance direction Ds of the sheet S by receiving a frictional force between the platen drum 30 and the sheet S. In this regard, the process section 3 is provided with driven rollers 33 and 34 that fold back the sheet S on both sides of the part at which the sheet S is wound on the platen drum 30. Of these driven rollers, the front surface of the sheet S is wound on the driven roller 33 between the front driving roller 31 and the platen drum 30 to fold back the sheet S. On the other hand, the front surface of the sheet S is wound on the driven roller 34 between the platen drum 30 and the rear driving roller 32 to fold back the sheet S. In this way, by folding back the sheet S respectively upstream and downstream of the platen drum 30 in the conveyance direction Ds, it is possible to secure a long length of the part at which the sheet S is wound on the platen drum 30.

The rear driving roller 32 has a plurality of minute protrusions formed on the outer circumferential surface of the rear driving roller 32 by thermal spraying, and the sheet S conveyed from the platen drum 30 via the driven roller 34 is wound on the rear driving roller 32 from the back surface side of the sheet S. In addition, by being rotated clockwise in FIG. 2, the rear driving roller 32 conveys the sheet S to the winding section 4. Note that a nip roller 32*n* is provided with respect to the rear driving roller 32. This nip roller 32*n* makes contact with the front surface of the sheet S while being biased toward a rear driving roller 32, and the sheet S is sandwiched between the nip roller 32*n* and the rear driving roller 32. This makes it possible to secure a frictional force between the rear driving roller 32 and the sheet S and reliably perform conveyance of the sheet S by the rear driving roller 32.

In this way, the sheet S conveyed from the front driving roller 31 to the rear driving roller 32 is supported by the front surface (curved surface) 30*a* of the platen drum 30. In addition, in the process section 3, in order to print a color image on the front surface of the sheet S supported by the platen drum 30, the process unit 3U is provided. The process unit 3U includes a pair of a front plate 35*a* and a rear plate 35*b* (see FIG. 4) provided in the front and the back respectively. The plates 35*a* and 35*b* each have an arc shape along the front surface 30*a* of the platen drum 30 and constitute a unit frame by being coupled to each other by a coupling member, which is not illustrated. In addition, structural elements (printing heads 36*a* to 36*e*, UV lamps 37*a* and 37*b*, and head movement mechanisms) of the process unit 3U are attached to the unit frame as described below.

The four respective printing heads (discharging heads) 36*a* to 36*d* corresponding to yellow, cyan, magenta, and black are aligned in this color order in the conveyance direction Ds. More specifically, these four printing heads 36*a* to 36*d* are disposed radially from the rotary shaft 301 of the platen drum 30. The two printing heads 36*a* and 36*b* disposed upstream in the conveyance direction Ds among the printing heads 36*a* to 36*d* are moved by one head movement mechanism and positioned with respect to the sheet S wound on the platen drum 30. The two printing heads 36*c* and 36*e* disposed downstream are moved by another head movement mechanism and positioned with respect to the sheet S wound on the platen drum 30. These two head movement mechanisms move and position the four printing heads 36*a* to 36*d*, so that it is possible to set a proper value to a distance, namely, a paper gap between a nozzle tip (discharge port of ink) of a nozzle surface 39 (see FIG. 3) of each of the printing heads 36*a* to 36*d* and the sheet S. In this way, each of the printing heads 36*a* to 36*d* discharges ink onto the sheet S wound on an outer circumferential portion of the platen drum 30 while the paper gap is adjusted, and thus a color image is formed on the front surface of the sheet S. A configuration and an operation of the head movement mechanism will be described later in detail.

Note that although it is not illustrated, a plurality of unit heads are arranged in two rows of a staggered pattern in the Y direction orthogonal to the conveyance direction Ds, and the plurality of unit heads each include a plurality of open nozzles aligned in the Y direction in the printing heads 36*a* to 36*e* in the exemplary embodiment, similarly to the printing heads in the printer described in JP-A-2017-196795. In this way, the nozzle surface 39 of each of the printing heads 36*a* to 36*e* is provided with the plurality of nozzles in the Y direction. In the exemplary embodiment, the nozzle surface 39 represents not only a surface in which nozzles are open in a unit head but also a surface in which a nozzle of each unit head is formed and a surrounding surface. Specifically, the nozzle surface 39 is a surface facing the platen drum 30, and also includes a region wiped by a wiper of a wiping mechanism in wiping processing described later. Therefore, the nozzle surface 39 is a surface facing the platen drum 30, and is also a region wiped by the wiper in the wiping processing.

As a liquid such as an ink and a recording liquid used in the printing heads 36*a* to 36*d*, an ultraviolet (UV) ink (photocurable ink), which is cured by being irradiated with ultraviolet rays (light), is used. Thus, in order to cure and fix the ink to the sheet S, the process unit 3U is provided with the UV lamps 37*a* and 37*b*. Note that this ink curing is performed in two separate stages of temporary curing and final curing. The UV lamps 37*a* for temporary curing are each disposed between the plurality of corresponding printing heads 36*a* to 36*d*. In other words, the UV lamps 37*a* are used for curing (performing temporary curing of) the ink to a degree such that the ink does not lose its shape by irradiating relatively weak ultraviolet rays, and are not used for completely curing the ink. On the other hand, the UV lamp 37*b* for final curing is provided downstream of the plurality of printing heads 36*a* to 36*d* in the conveyance direction Ds. In other words, the UV lamp 37*b* is used for completely curing (performing final curing of) the ink by irradiating ultraviolet rays stronger than the ultraviolet rays of the UV lamps 37*a*. Thus, the color image formed by the plurality of printing heads 36*a* to 36*d* can be fixed to the front surface of the sheet S by performing temporary curing and final curing.

Furthermore, the printing head 36*e* is provided downstream of the UV lamp 37*b* in the conveyance direction Ds. The printing head 36*e* faces the front surface of the sheet S wound on the platen drum 30 with slight clearance between the printing head 36*e* and the front surface, and discharges a clear UV ink onto the front surface of the sheet S by an ink jet method. In other words, a clear ink is further discharged to the color image formed by the printing heads 36*a* to 36*d* in four colors. Note that a proper value is set to a paper gap of the printing head 36*e* by moving and positioning the printing head 36*e* alone by a different head movement mechanism from the head movement mechanisms that have already been described.

In this way, the printing heads 36*a* to 36*e*, the UV lamps 37*a* and 37*b*, and the head movement mechanisms are attached to the unit frame and constitute the process unit 3U. When a normal operation, namely, printing processing is performed, the process unit 3U is positioned between the feeding section 2 and the winding section 4 as indicated by solid lines in FIG. 1. On the other hand, when a maintenance operation of the process unit 3U, such as wiping processing and capping processing performed on the printing heads 36*a* to 36*e*, is performed, the process unit 3U is moved to the maintenance section 5 by a slide driving mechanism (not illustrated) as indicated by dot-and-dash lines in FIG. 1.

Next, a specific configuration of the UV lamp 37*a* will be described, and a positional relationship between the printing heads 36*a*, 36*b* and the UV lamp 37*a* will also be described with reference to FIG. 3.

The UV lamp 37*a* in the exemplary embodiment corresponds to an irradiation section in the invention. As illustrated in FIG. 3, the UV lamp 37*a* includes a housing 371 and a light emitting section 372 that is accommodated inside the housing 371 and irradiates light (UV light) curing a liquid, and is configured to irradiate the sheet S supported by the front surface 30*a* of the platen drum 30 with the UV light emitted from the light emitting section 372 via an irradiation port 373 defined by the housing 371. As the light emitting section 372, an LED, a metal halide lamp, a xenon lamp, a carbon arc lamp, a chemical lamp, a low-pressure mercury lamp, a high-pressure mercury lamp, and the like may be used.

In the conveyance direction Ds of the sheet S, a light-shielding plate (first light-shielding plate) 70*a* located upstream of a light-shielding plate 70*b* is disposed between the printing head (first discharging head) 36*a* located upstream of the printing head 36*b* and the UV lamp 37*a*, and the light-shielding plate (second light-shielding plate) 70*b* located downstream is disposed between the printing head (second discharging head) 36*b* located downstream and the UV lamp 37*a*. The light-shielding plates 70*a* and 70*b* are plate-shaped members for reducing the UV light irradiated through the irradiation port 373 of the UV lamp 37*a* being incident to the nozzle surfaces 39 of the printing heads 36*a* and 36*b*. As illustrated in FIG. 3, a gap $G_1$ between the light-shielding plates 70*a*, 70*b* and the front surface 30*a* of the platen drum 30 is set to be wider than a gap $G_2$ between the printing heads 36*a*, 36*b* and the front surface 30*a* of the platen drum 30 in the exemplary embodiment.

Figure 3:
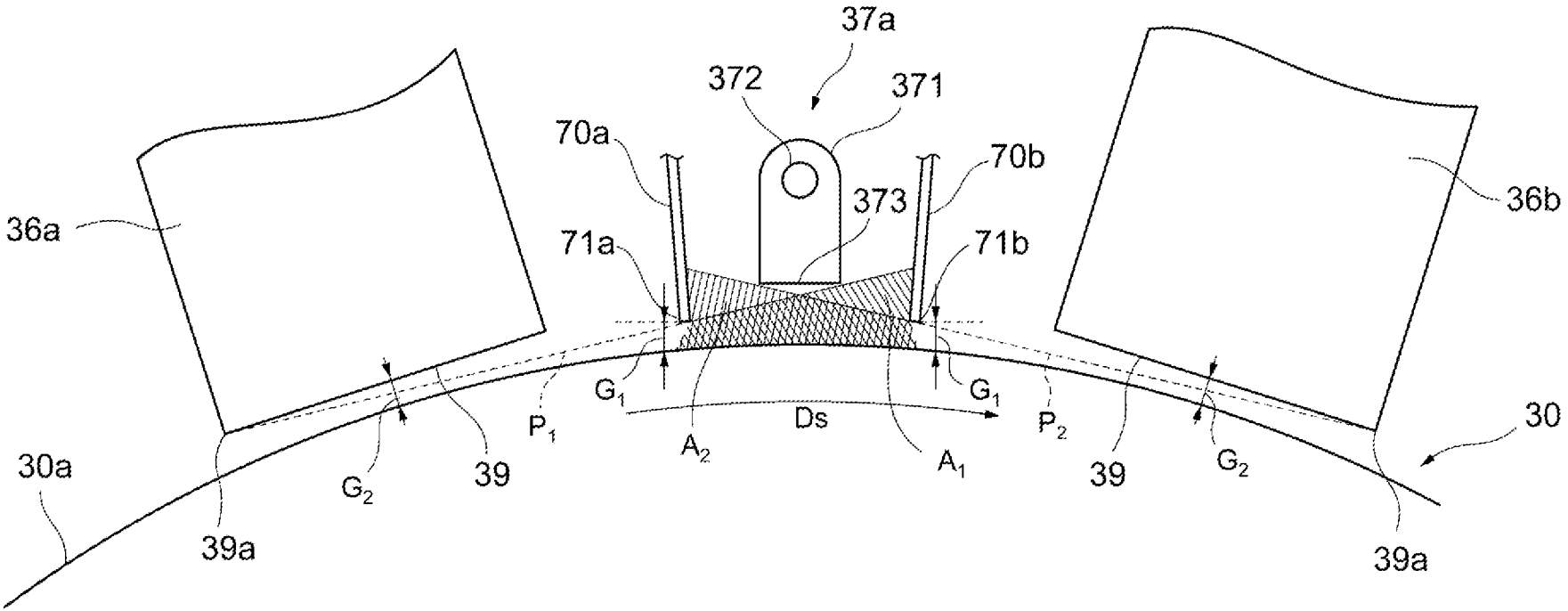
FIG. 3 is a diagram illustrating a positional relationship between a printing head and a UV lamp of the printing apparatus according to the exemplary embodiment of the invention.

Herein, when the UV lamp 37*a* is disposed inside a region $A_1$ indicated by lines diagonally to the lower right in FIG. 3, light irradiated from the light source 372 is reflected by the front surface 30*a* of the platen drum 30 or the front surface of the sheet S and becomes reflected light, and the reflected light is scattered by shining on the housing 371 and becomes scattered light. The light-shielding plate 70*a* located upstream cannot prevent the scattered light from being directly incident to the printing head 36*a* located upstream. When the housing 371 of the UV lamp 37*a* is disposed inside a region $A_2$ indicated by lines diagonally to the upper right in FIG. 3, the light-shielding plate 70*b* located downstream cannot prevent scattered light scattered by shining on the housing 371 from being directly incident to the printing head 36*b* located downstream.

Thus, in the exemplary embodiment, as illustrated in FIG. 3, the housing 371 of the UV lamp 37*a* is disposed in a position farther from the front surface 30*a* of the platen drum 30 than a virtual tangent plane (first virtual tangent plane) $P_1$ that passes through a portion 39*a* of the nozzle surface 39 of the printing head 36*a* located upstream being farthest from the irradiation port 373 and that contacts a lower end 71*a* of the light-shielding plate 70*a* located upstream. The housing 371 of the UV lamp 37*a* is also disposed in a position farther from the front surface 30*a* of the platen drum 30 than a virtual tangent plane (second virtual tangent plane) $P_2$ that passes through a portion 39*a* of the nozzle surface 39 of the printing head 36*b* located downstream being farthest from the irradiation port 373 and that contacts a lower end 71*b* of the light-shielding plate 70*b* located downstream.

In this way, since the housing 371 of the UV lamp 37*a* is disposed in the position farther from the front surface 30*a* of the platen drum 30 than the two virtual tangent planes $P_1$ and $P_2$, the light-shielding plates 70*a* and 70*b* can intercept the scattered light around the irradiation port 373 in the housing 371 being directly incident to the nozzle surfaces 39, and a part of scattered light scattered by shining on the housing 371 can be prevented from being directly incident to the nozzle surfaces 39 of the printing heads 36*a* and 36*b*. A positional relationship between the printing heads 36*b*, 36*c* and the UV lamp 37*a* disposed therebetween, a positional relationship between the printing heads 36*c*, 36*d* and the UV lamp 37*a* disposed therebetween, and a positional relationship between the printing heads 36*d*, 36*e* and the UV lamp 37*b* disposed therebetween are substantially similar to the positional relationship between the printing heads 36*a*, 36*b* and the UV lamp 37*a* disposed therebetween that has already been described. Thus, detailed description will be omitted.

Referring back to FIG. 2, description of the configuration of the process section 3 and the winding section 4 continues. In the process section 3, a UV lamp 38 is provided downstream of the printing head 36*e* in the conveyance direction Ds. The UV lamp 38 is used for completely curing (performing final curing of) the clear ink discharged by the printing head 36*e* by irradiating strong ultraviolet rays. This can fix the clear ink to the front surface of the sheet S.

The sheet S on which the color image is formed by the process section 3 is conveyed to the winding section 4 by the rear driving roller 32. In addition to the winding shaft 40 around which the edge of the sheet S has been wound, the winding section 4 includes a driven roller 41 for winding the sheet S between the winding shaft 40 and the rear driving roller 32 from the back surface side of the sheet S. The winding shaft 40 supports the sheet S by winding the edge of the sheet S around the winding shaft 40 with the front surface of the sheet S facing outward. That is, when the winding shaft 40 is rotated clockwise in FIG. 2, the sheet S conveyed from the rear driving roller 32 is wound around the winding shaft 40 via the driven roller 41. In this regard, the sheet S is wound around the winding shaft 40 via a core pipe (not illustrated) that is detachable from the winding shaft 40. Thus, when the sheet S wound around the winding shaft 40 becomes full, it is possible to detach the sheet S together with the core pipe.

Next, a configuration of a heat movement mechanism equipped in the process unit 3U will be described in detail with reference to FIG. 4.

Figure 4:
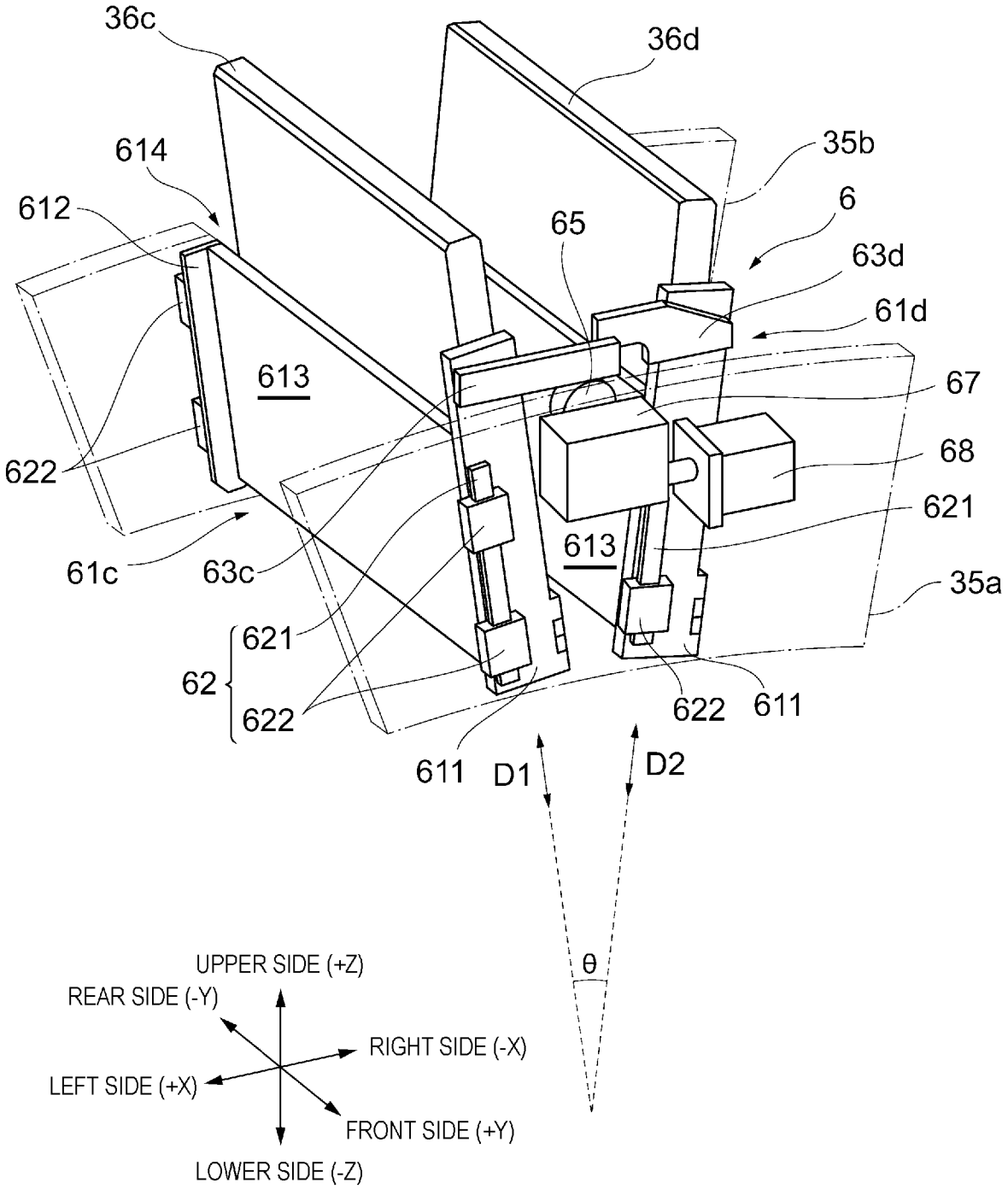
FIG. 4 is a perspective view of a head movement mechanism of the printing apparatus according to the exemplary embodiment of the invention when seen from the front.

FIG. 4 is a perspective view of a configuration of two printing heads and a head movement mechanism that moves and positions the printing heads when seen from the front. Hereinafter, a configuration and an operation of a head movement mechanism 6 that drives the printing heads 36*c* and 36*d* will be described with reference to FIG. 4. A head movement mechanism that moves the printing heads 36*a* and 36*b* is also similar to the head movement mechanism 6, so that description of a configuration and an operation of the head movement mechanism will be omitted.

Given that a direction perpendicular to a tangent line of the platen drum 30 in a position in which the printing head 36*c* performs printing (a landing position of a magenta ink) (namely, a radiation direction that passes through the landing position from the rotary shaft 301 of the platen drum 30) is a first direction D1, the head movement mechanism 6 moves the printing head 36*c* in the first direction D1 and positions the printing head 36*c*. At the same time, given that a direction perpendicular to the tangent line of the platen drum 30 in a position in which the printing head 36*d* performs printing (a landing position of a black ink) (namely, a radiation direction that passes through the landing position from the rotary shaft 301 of the platen drum 30) is a second direction D2, the head movement mechanism 6 moves the printing head 36*d* in the second direction D2 and positions the printing head 36*d*. In this way, in the exemplary embodiment, the movement directions D1 and D2 of both the respective printing heads 36*c* and 36*d* are inclined an angle θ from each other, and the head movement mechanism 6 has a function of moving and positioning both the printing heads 36*c* and 36*d* while maintaining the angular relationship.

The head movement mechanism 6 includes a holder 61*c* for holding the printing head 36*c*. The holder 61*c* includes a front holder member 611, a rear holder member 612, and a coupling plate 613 that couples both the holder members 611 and 612 to each other. The printing head 36*c* is insertable into the holder 61*c* from the (−Y) direction via an opening 614 provided in the rear holder member 612.

A linear guide 62 extends in the first direction D1 on each of a front surface of the front holder member 611 and a rear surface of the rear holder member 612, and the holder 61*c* is configured to be movable in the first direction D1 with respect to the front plate 35*a* and the rear plate 35*b* by these two linear guides 62. More specifically, a linear rail 621 extending in the first direction D1 is fixed to the front surface of the front holder member 611, and two sliders 622 and 622 are also attached to the front surface of the front holder member 611 along the rail 621 to be slidable in the first direction D1. In addition, these two sliders 622 and 622 are fixed to a rear surface of the front plate 35*a*. The linear guide 62 having a similar configuration to that of the linear guide 62 of the front holder member 611 is also attached to the rear surface of the rear holder member 612, and the sliders 622 and 622 of the linear guide 62 are fixed to a front surface of the rear plate 35*b*. In this way, the two linear guides 62 and 62 are respectively provided in the front and the back of the holder 61*c*, so that the holder 61*c* is movable in the first direction D1 while holding the printing head 36*c*.

In addition, in the head movement mechanism 6, a holder 61*d* for holding the printing head 36*d* is provided downstream of the holder 61*c* in the conveyance direction Ds at a predetermined distance away from the holder 61*c*. The holder 61*d* includes a front holder member 611, a rear holder member 612, and a coupling plate 613, similarly to the holder 61*c*. The printing head 36*d* is insertable into the holder 61*d* via an opening 614 provided in the rear holder member 612. A linear guide 62 extends in the second direction D2 on each of a front surface of the front holder member 611 and a rear surface of the rear holder member 612, and the holder 61*d* is configured to be movable in the second direction D2 with respect to the front plate 35*a* and the rear plate 35*b* by these two linear guides 62. Note that the linear guide 62 provided on the holder 61*d* has the same configuration as that of the linear guide 62 provided on the holder 61*c* except that an extending direction of a rail 621 is different. Thus, the same reference sign is provided herein, and detailed description will be omitted.

One of end portions of a left cam follower 63*c* is fixed to the front holder member 611 constituting the holder 61*c*, and the other end portion extends to the right toward the holder 61*d* and extends to a substantially middle position between both the front holder members 611. The other end portion of the left cam follower 63*c* is formed as a thin-walled portion obtained by slightly cutting off a rear portion, and a first bearing (not illustrated) is rotatably attached to the left cam follower 63*c* in a rear direction of the thin-walled portion. The first bearing contacts a cam 65 described later. Further, a second bearing (not illustrated) is rotatably attached to be closer to the other end portion of the left cam follower 63*c* than the first bearing. The second bearing contacts a plane portion of a right cam follower 63*d* described later.

One of end portions of the right cam follower 63*d* is fixed to the front holder member 611 constituting the holder 61*d*, and the other end portion extends to the left toward the holder 61*c* and extends to a substantially middle position between both the front holder members 611. The right cam follower 63*d* is configured to work together with the left cam follower 63*c* via the second bearing (not illustrated) attached to the left cam follower 63*c*, and is also configured to be able to change a position in the right-and-left direction with respect to the left cam follower 63*c*. The other end portion of the right cam follower 63*d* is provided with the plane portion that contacts the second bearing. The plane portion achieves a state where the right cam follower 63*d* works together with the left cam follower 63*c* and changes a position of the right cam follower 63*d* with respect to the left cam follower 63*c*.

The cam 65 is disposed rotatably between the holders 61*c* and 61*d*. The cam 65 is disposed to contact the first bearing attached to the left cam follower 63*c* and not to contact the second bearing. An outer circumferential surface of the cam 65 makes contact with an outer circumferential surface of the first bearing, and thus the other end portion of the left cam follower 63*c* is supported. An outer circumferential surface of the second bearing attached to the left cam follower 63*c* makes contact with the plane portion of the right cam follower 63*d*, and thus the other end portion of the right cam follower 63*d* is supported. In other words, the cam 65 indirectly supports the other end portions of both the cam followers 63*c* and 63*d*.

The cam 65 is formed to be slightly thicker than a thickness of the cam followers 63*c* and 63*d*, and is attached to a cam shaft (not illustrated) extending in the front-back direction Y. The cam shaft is coupled to an actuator 68 such as a motor via a power transmission section 67, and the power transmission section 67 transmits driving force generated in the actuator 68 to the cam shaft. In this way, the cam shaft rotates about an axis, which also causes the cam 65 to rotate. The rotation of the cam 65 causes the first bearing that contacts the cam 65 to rotate and also causes the left cam follower 63*c* to change a position with respect to the cam shaft. In this way, the printing head 36*c* moves in the first direction D1, whereas the right cam follower 63*d* working together with the left cam follower 63*c* via the second bearing changes a position with respect to the cam shaft and the left cam follower 63*c*. This causes the printing head 36*d* to move in the second direction D2.

Note that the printing heads 36*a* and 36*b* are also positioned by the head movement mechanism having the same configuration as that of the head movement mechanism 6, similarly to the printing heads 36*c* and 36*d*. The remaining printing head 36*e* is positioned by a different head movement mechanism.

When preparation for the printing operation is completed in this way, the printing operation is performed, but the maintenance operation of the process unit 3U may need to be performed depending on an operation state of the apparatus. In this maintenance operation, the whole process unit 3U is moved toward the rear, namely, in the (−Y) direction and subjected to various maintenance processing in the maintenance section 5. Examples of the maintenance processing particularly related to the printing heads 36*a* to 36*e* include wiping processing. The wiping processing is performed in order to prevent the nozzle of each of the printing heads 36*a* to 36*e* from becoming clogged. The maintenance section 5 is provided with a wiping mechanism (not illustrated) for performing the wiping processing. Then, the wiping processing is performed by a wiper in the wiping mechanism on the process unit 3U moved to the maintenance section 5.

In the configuration in which the platen drum 30 is used as the support member of the sheet S and the UV lamp 37*a* is disposed between the two printing heads 36*a* and 36*b* as in the exemplary embodiment, scattered light scattered by the front surface 30*a* of the platen drum 30 or the front surface of the sheet S among light irradiated from the UV lamp 37*a* cannot be completely prevented even by using the light-shielding plates 70*a* and 70*b*. Thus, as described above, the nozzles of the printing heads 36*a* and 36*b* are prevented from becoming clogged by periodically performing various maintenance processing in the maintenance section 5.

However, in the printing apparatus 1 according to the exemplary embodiment described above, since the housing 371 of the UV lamp 37*a* is disposed in the position farther from the front surface 30*a* of the platen drum 30 than the two virtual tangent planes $P_1$ and $P_2$, the light-shielding plates

70*a* and 70*b* can intercept all scattered light scattered by shining on the housing 371 around the irradiation port 373 of the UV lamp 37*a*, and a part of the light scattered by the housing 371 can be prevented from being incident to the nozzle surfaces 39 of the printing heads 36*a* and 36*b*. Therefore, the amount of leakage light incident to the nozzle surfaces 39 of the printing heads 36*a* and 36*b* can be reduced further than that in a known printing apparatus using photocurable ink. Thus, an interval at which the above-described maintenance processing is performed can be set to be longer than that in the known printing apparatus, and print efficiency can be improved.

In addition, in the printing apparatus 1 according to the exemplary embodiment described above, since the gap $G_1$ between the light-shielding plates 70*a*, 70*b* and the front surface 30*a* of the platen drum 30 is set to be wider than the gap $G_2$ between the printing heads 36*a*, 36*b* and the front surface 30*a* of the platen drum 30, the light-shielding plates 70*a* and 70*b* can be prevented from making contact with the sheet S supported by the front surface 30*a* of the platen drum 30. As a result, damage to the sheet S can be prevented.

Note that while a positional relationship when a printing head (discharging head) is disposed both upstream and downstream of a UV lamp (irradiation section) is described in the above-described exemplary embodiment, the invention is also certainly applicable to a case where a printing head (discharging head) is disposed either only upstream or downstream of a UV lamp (irradiation section).

For example, when the printing head 36*e* located upstream of the UV lamp 38 illustrated in FIG. 2 is disposed to be relatively close to the UV lamp 38, light scattered by a housing of the UV lamp 38 may be incident to a nozzle surface of the printing head 36*e* even with a light-shielding plate disposed between the UV lamp 38 and the printing head 36*e*. In such a case, the housing of the UV lamp 38 is disposed in a position farther from the front surface 30*a* of the platen drum 30 than a virtual tangent plane that passes through a portion of the nozzle surface of the printing head 36*e* being farthest from an irradiation port of the UV lamp 38 and that contacts a lower end of the light-shielding plate. In this way, when the housing of the UV lamp 38 is disposed in the position farther from the front surface 30*a* of the platen drum 30 than the virtual tangent plane, the light-shielding plate can intercept all scattered light scattered by shining on the housing around the irradiation port of the UV lamp 38, and a part of the light scattered by the housing can be prevented from being incident to the nozzle surface of the printing head 36*e*.

In addition, while the example in which the invention is applied to the printing apparatus 1 of a so-called drum type using the platen drum 30 is illustrated in the above-described exemplary embodiment, the invention is also applicable to a printing apparatus different from the drum-type printing apparatus 1.

Figure 5:
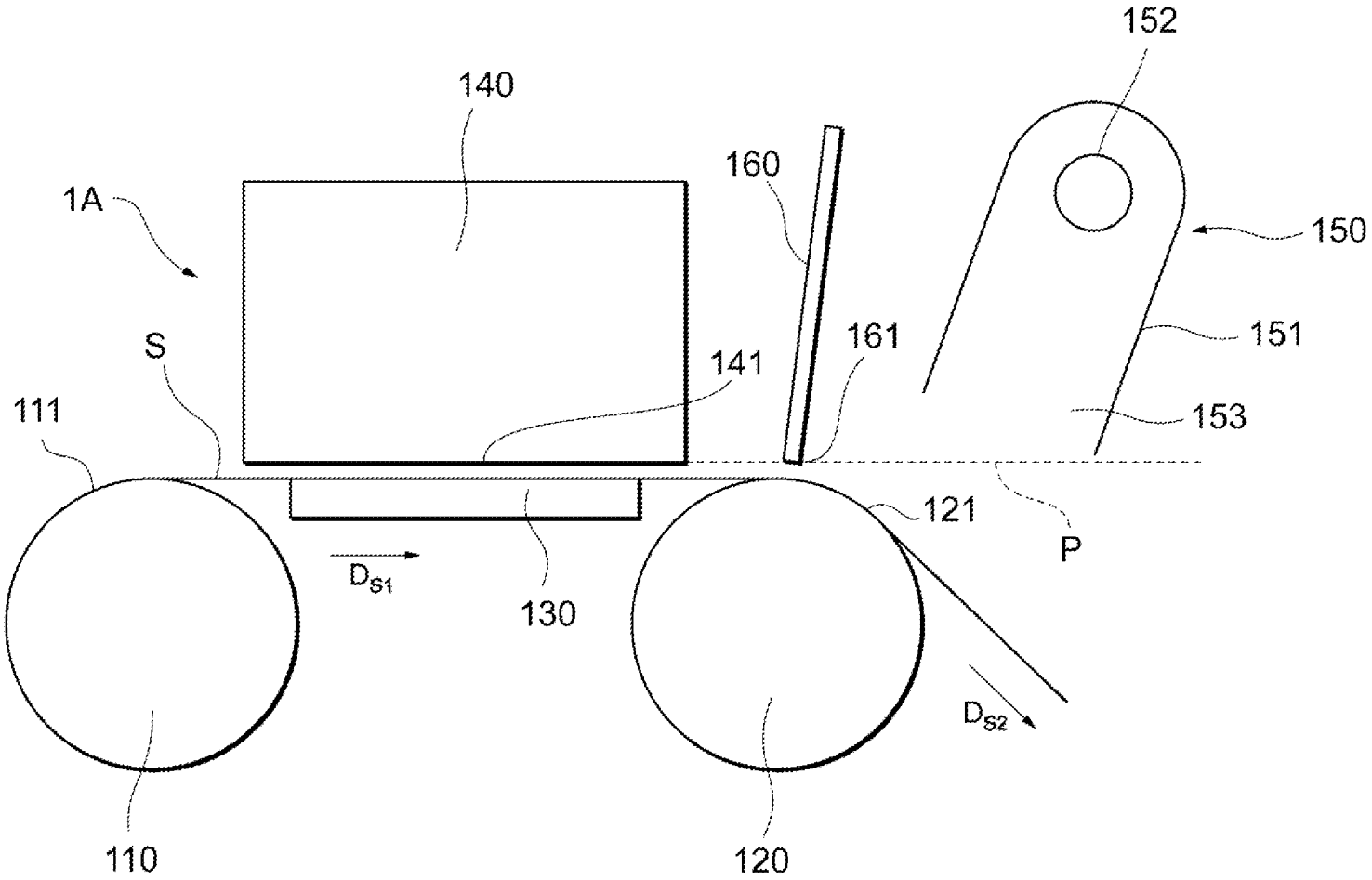
FIG. 5 is a diagram illustrating a positional relationship between a printing head and a UV lamp of a printing apparatus according to another exemplary embodiment of the invention.

For example, as illustrated in FIG. 5, in a printing apparatus 1A, a sheet S is conveyed in a first conveyance direction $D_{S1}$ while the sheet S is supported by a front surface 111 of a front roller 110, a front surface (curved surface) 121 of a rear roller 120 (support member), and a guide 130 having a flat support surface, a nozzle of a nozzle surface 141 of a printing head (discharging head) 140 discharges UV ink onto a front surface of the sheet S to print an image, the front surface 121 of the rear roller 120 then changes the conveyance direction of the sheet S to a second conveyance direction $D_{S2}$, a UV lamp (irradiation section) 150 including a housing 151 and a light emitting section 152 is disposed downstream of the rear roller 120, and a light-shielding plate 160 is disposed between the printing head 140 and the UV lamp 150. In the printing apparatus 1A, scattered light scattered by shining on the housing 151 of the UV lamp 150 around an irradiation port 153 of the UV lamp 150 may be incident to the nozzle surface 141 of the printing head 140 depending on a position of the UV lamp 150.

Thus, in the printing apparatus 1A having such a configuration, as illustrated in FIG. 5, the housing 151 of the UV lamp 150 is disposed in a position farther from the front surface 121 of the rear roller 120 than a virtual tangent plane P that passes through a portion of the nozzle surface 141 of the printing head 140 being farthest from the irradiation port 153 of the UV lamp 150 and that contacts a lower end 161 of the light-shielding plate 160. In this way, when the housing 151 of the UV lamp 150 is disposed in the position farther from the front surface 121 of the rear roller 120 than the virtual tangent plane P, the light-shielding plate 160 can intercept all scattered light scattered by shining on the housing 151 of the UV lamp 150 around the irradiation port 153 of the UV lamp 150, and a part of the light scattered by the housing 151 can be prevented from being incident to the nozzle surface 141 of the printing head 140.

The invention is not limited to each of the exemplary embodiments described above, and the exemplary embodiments to which design changes are appropriately added by a person skilled in the art also fall within the scope of the invention as long as the exemplary embodiments have the characteristics of the invention. In other words, respective elements provided in the exemplary embodiments and arrangement, materials, conditions, shapes, dimensions, and the like of the elements are not limited to the examples and can be appropriately changed. In addition, respective elements provided in the exemplary embodiments can be combined as far as technically possible, and the elements in combination also fall within the scope of the invention as long as the elements have the characteristics of the invention.

This application claims priority under 35 U.S.C. § 119 to Japanese Patent Application No. 2018-038727, filed Mar. 5, 2018. The entire disclosure of Japanese Patent Application No. 2018-038727 is hereby incorporated herein by reference.

What is claimed is:

1. A printing apparatus comprising:

a support member including a curved surface configured to support a recording medium conveyed in a predetermined conveyance direction;

a discharging head configured to discharge liquid from a nozzle of a nozzle surface disposed in a position facing the support member to print an image on the recording medium supported by the curved surface;

an irradiation section including a housing and a light emitting section accommodated inside the housing and configured to irradiate light for curing the liquid, the irradiation section being configured to irradiate the recording medium supported by the curved surface with light emitted from the light emitting section via an irradiation port defined by the housing; and a light-shielding plate disposed between the discharging head and the irradiation section in the conveyance direction, wherein the housing is disposed in a position farther from the curved surface than a virtual tangent plane that passes through a portion of the nozzle surface being farthest from the irradiation port and that contacts a lower end of the light-shielding plate, a gap between the light-shielding plate and the support member is wider than a gap between the discharging head and the support member, and the nozzle surface and the irradiation port are not parallel.

2. The printing apparatus according to claim 1, wherein the discharging head is a first discharging head disposed upstream of the irradiation section in the conveyance direction, the light-shielding plate is a first light-shielding plate disposed upstream of the irradiation section in the conveyance direction, the virtual tangent plane is a first virtual tangent plane that passes through a position of the nozzle surface of the first discharging head being farthest from the irradiation port and that contacts a lower end of the first light-shielding plate, the printing apparatus further includes a second light-shielding plate disposed downstream of the irradiation section in the conveyance direction, and a second discharging head disposed downstream of the second light-shielding plate in the conveyance direction, and the housing is disposed in a position farther from the curved surface than a second virtual tangent plane that passes through a portion of the nozzle surface of the second discharging head being farthest from the irradiation port and that contacts a lower end of the second light-shielding plate.

* * * * *